US005253491A

United States Patent [19]

Buontempo et al.

[11] Patent Number: 5,253,491

[45] Date of Patent: Oct. 19, 1993

[54] FINGER RING AND SIZE ADJUSTMENT INSERT

[75] Inventors: Rudolph Buontempo, 121 Sherwood St., Providence, R.I. 02908; Marek R. Zamojski, North Providence, R.I.

[73] Assignee: Rudolph Buontempo, Providence, R.I.

[21] Appl. No.: 936,274

[22] Filed: Aug. 28, 1992

[51] Int. Cl.[5] ..... A44C 9/02

[52] U.S. Cl. ..... 63/15.6

[58] Field of Search ..... 63/15.1, 15.3, 15.5, 63/15.6, 15.8

[56] References Cited

U.S. PATENT DOCUMENTS

| | | | |
|---|---|---|---|
| 1,075,673 | 10/1913 | Segman | 63/15.6 |
| 1,219,172 | 3/1917 | Segman | 63/15.6 |
| 1,278,047 | 9/1918 | Smith | 63/15.6 |
| 2,224,073 | 12/1940 | Augenstein | 63/15.6 |
| 2,745,265 | 5/1956 | Grafstein | 63/15.6 |
| 2,826,050 | 3/1958 | Oates | 63/15.6 |
| 2,966,048 | 12/1960 | Goossev | 63/15.6 |
| 3,603,109 | 9/1971 | Virtanen | 63/15.6 |
| 3,835,664 | 9/1974 | Nesbit | 63/15.6 |

*Primary Examiner*—Peter M. Cuomo
*Assistant Examiner*—Michael Milano
*Attorney, Agent, or Firm*—Salter, Michaelson & Benson

[57] ABSTRACT

In a combination of a finger ring and a size adjustment insert, the finger ring and the insert are provided with complementary interengaging portions that permit the insert to be twist received in frictional engagement adjacent the back side of the head of the ring. The insert is formed from a resilient plastic material and includes a male protrusion which is adapted to be twist-received into a complementary female opening formed in the back side of the decorative head of the finger ring.

4 Claims, 2 Drawing Sheets

FINGER RING AND SIZE ADJUSTMENT INSERT

BACKGROUND OF THE INVENTION

The instant invention relates generally to the jewelry art and more particularly relates to a finger ring having means for adjusting the size of the ring shank.

The desirability of providing adjustable-size finger rings has long been established, primarily as a means for permitting jewelry retailers to minimize inventory requirements. In addition, it is well known that it is often desirable to wear rings on different fingers of the hand or to wear rings that were originally fitted for another person's finger. For all of these reasons, means have heretofore been provided for permitting ready adjustment of the ring size. In less expensive costume jewelry, it is well known to leave one end of the ring shank disconnected from the ring head or ornament whereby the size may be adjusted by manipulation of the shank. However, this technique lends itself to only relatively inexpensive jewelry.

Another concept is to provide an insert that cooperates with the ring shank to reduce the size of the shank opening. Examples of prior art which suggest this technique are the U.S. Pat. Nos. 2,745,265 to Grafstein; 2,966,048 to Goosev and 3,835,664 to Nesbit, but these are either too complicated and intricate, too uncomfortable in use, too difficult to assemble, or too insecure when in their assembled position. The present invention is directed to the provision of an insert that overcomes all of these prior art shortcomings.

SUMMARY OF THE INVENTION

The instant invention provides, in combination, a finger ring and insert for reducing the size of the finger-receiving opening of the ring, each of which include complementary interengaging means that permit the insert to be releasably received in frictional twisting engagement adjacent to the back side of the ornamental head portion of the finger ring.

Briefly, the finger ring comprises a decorative head and a ring shank which cooperate to define a circular finger-receiving opening of a predetermined size. The decorative head includes an outwardly facing decorative side and an inwardly facing back side. The insert is preferably formed from a resilient plastic material and it comprises an arcuate body having an upper convex surface and a lower concave surface. The upper surface of the insert body has formed thereon a male protrusion which projects toward the back side of the ring head, which in turn has a complementary female opening in which the male protrusion is adapted to be twist-received. The male protrusion comprises a circular pedestal portion which projects upwardly and a pair of diametrically opposed wing portions which extend outwardly therefrom. The female opening is complementary in shape and includes two recessed portions at the sides thereof for receiving the wing portions of the male protrusion. The insert is received adjacent the back side of the ring head, and is maintained in position by the frictional twist-engagement of the male protrusion and the female opening whereby the lower convex surface of the insert merges with the ring shank to provide a finger-receiving opening of reduced size.

Accordingly, it is an objective of the instant invention to provide, in combination, a finger ring and an insert for reducing the size of the finger-receiving opening of the ring.

It is another object of the instant invention to provide, in combination, a finger ring and an insert which include complementary interengaging means that permit the insert to be releasably received in twist-engagement adjacent to the back side of the ring head.

It is still another object of the invention to provide a size adjustment insert having a male protrusion thereon and a finger ring having a complementary female opening formed in the back side of the head of the ring for receiving the male protrusion in twisting engagement.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
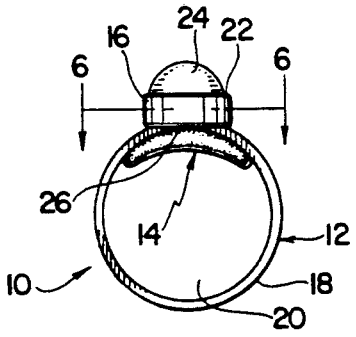
FIG. 1 is a side elevational view of the finger ring and size-adjustment insert of the instant invention.

Referring now to the drawings, the combination finger ring and size-adjustment insert of the instant invention is illustrated and it is generally indicated at 10 in FIG. 1. The instant invention comprises a finger ring generally indicated at 12, and a size adjustment insert generally indicated at 14.

The finger ring 12 is preferably formed from a rigid metal, and it comprises a decorative head 16 and a ring shank 18 which cooperate to define a finger-receiving opening 20 of a predetermined size. The decorative head 16 includes an outwardly facing decorative side 22 which, as illustrated, comprises a gemstone 24. The decorative side 22 may alternatively comprise a decorative design formed directly into or on top of the ring head 16. The decorative head 16 further includes an inwardly facing back side 26 which cooperates with the ring shank 18 in order to define the circular finger-receiving opening 20.

Figure 2:
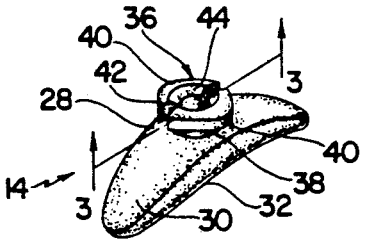
FIG. 2 is a perspective view of the insert thereof.
Figure 5:
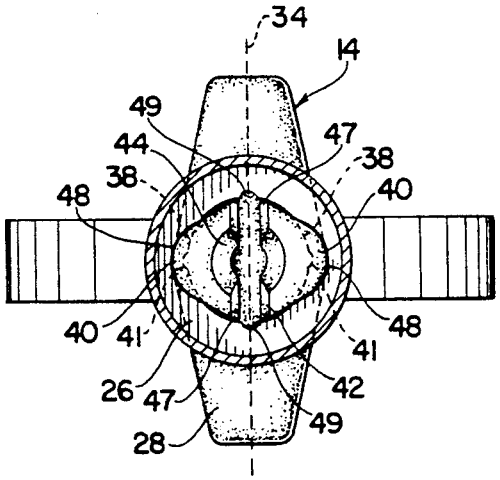
FIG. 5 is a similar sectional view with the insert received in the female opening before twisting thereof into locking position.
Figure 3:
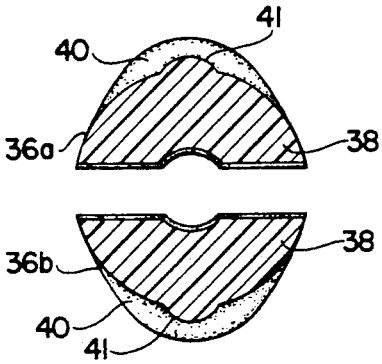
FIG. 3 is a sectional view of the male protrusion thereof taken along line 3—3 of FIG. 2.

The insert 14 is most clearly illustrated in FIG. 2 and it is preferably formed from a resilient plastic material, such as polyethylene, which is comfortable to wear against the skin and which is smooth so as not to provide any sharp edges which might snag clothing. The insert 14, which is preferably made by molding, comprises an arcuate, elongate body 28 of predetermined thickness and has an upper, generally convex surface 30, a lower, generally concave surface 32 and a longitudinal centerline 34 (FIG. 5). The insert 14, when assembled with ring 12, covers approximately one-quarter of the inner surface of the shank 18 wherein the arcuate body 28 merges with the shank 18 so that the lower concave surface 32 thereof cooperates with the inner surface of the shank 18 to define a reduced, substantially smooth opening for receiving the wearer's finger. The upper surface 32 of the insert has formed thereon a male protrusion generally indicated at 36 which projects toward the back side 26 of the ring head 16. The male protrusion 36 comprises a circular pedestal portion 38 projecting upwardly from the insert and a pair of wing portions 40 which extend outwardly therefrom in perpendicular relation to the centerline 34. The pedestal portion 38 includes two diametrically opposite bumps 41 (FIG. 3) on the outer surface thereof which are aligned in linear relation with the wings 40. The male protrusion 36 is divided into two symmetrical halves 36*a* and 36*b* by a V-shaped channel 42 which is formed therein along the longitudinal centerline 34 of the insert 14. The channel 42 allows the two halves 36*a* and 36*b* to be biased slightly inwardly when twist-received with the ring. The male protrusion 36 further includes a conical depression 44 which is formed in the top thereof. The conical depression 44 operates to receive the pointed rear end of a gemstone 24 which may be mounted in the ring head 16.

Figure 4:
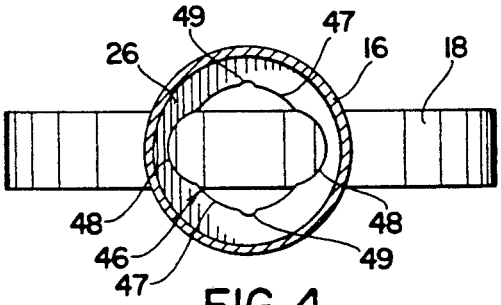
FIG. 4 is a sectional view taken along line 6—6 of FIG. 1 showing the ring head and female opening without the insert.

As illustrated in FIG. 4, the back side 26 of the decorative head 16 includes a complementary female opening generally indicated at 46 in which the male protrusion is twist-received. The female opening 46 includes a substantially circular portion 47 having generally the same diameter as the pedestal portion 38 of the male protrusion 36, and two diametrically opposite recessed portions 48 for receiving the wing portions 40 of the male protrusion 36. The circular portions 47 include small indentations 49 for receiving the bumps 41 on the pedestal of the insert when the insert is assembled with the ring. The recessed portions 48 of the female opening 46 are oriented in linear alignment with the ring shank 18 so that the body 28 of the insert 14 can be initially received perpendicular to the plane of the ring shank 18 (FIG. 5).

Figure 7:
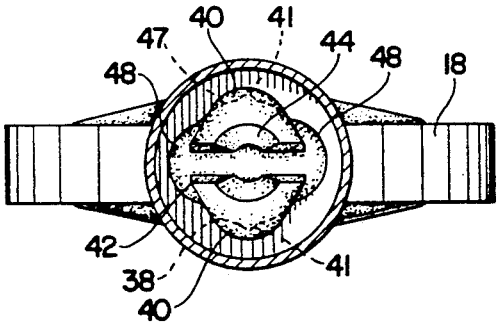
FIG. 7 is yet another sectional view with the insert twisted 90° into locking position.
Figure 6:
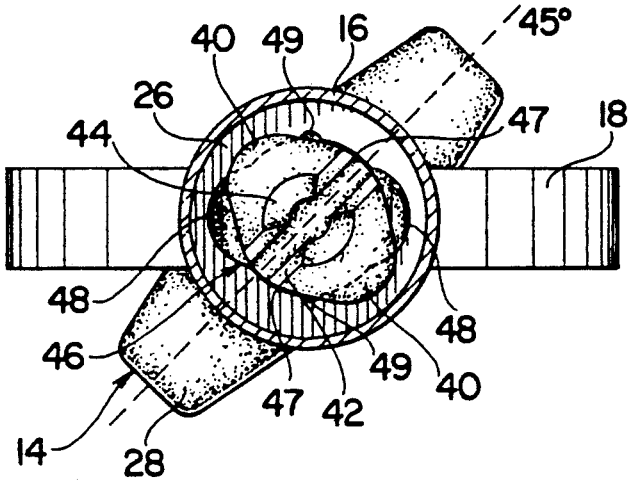
FIG. 6 is another sectional view taken along line 6—6 of FIG. 1 with the insert twisted 45°.

To assemble the size-adjustment insert 14 with the ring 12, the male protrusion 36 is received in the female opening 46 as illustrated in FIG. 5 with the body 28 of the insert 14 oriented perpendicular to the plane of the ring shank 18. The insert 14 is then rotated or twisted 90° so that body 28 aligns with the plane of the ring shank 18 (FIGS. 6 and 7). In this manner, the lower convex surface 32 of the insert merges with the inner surface of the shank to provide a finger-receiving opening of reduced size. During rotation of the insert (FIG. 6), the halves 36*a* and 36*b* of the protrusion 36 are biased inwardly due to the bumps 41 on the pedestal portion 38 coming into contact with the walls of the circular portion 47 of the opening 46. In the assembled position, the bumps 41 engage with the indentations 49 in the circular portions 47 of the opening wherein the halves 36*a* and 36*b* spring back outwardly to their normal position and prevent the insert from inadvertent rotation. In the assembled position, the wing portions 40 frictionally engage with the circular portions 47 of the opening 46 to maintain the insert 14 in assembled relation with the ring 12.

It is seen therefore that the insert is received adjacent to the back side 26 of the decorative head 16 and is maintained there by the frictional twist-engagement of the male protrusion and the female opening. It can be appreciated that the insert 14 is effectively received in combination with the ring 12 and thereby reduces the size of the finger-receiving opening of the ring 12. In this regard, a plurality of different thickness inserts may be provided in order to adjust the size of the finger-receiving opening to any desired size.

It is to be understood that other embodiments of the male and female twist engagement means are contemplated within the scope of the invention. Obviously, it is possible that the male protrusion could extend from the back side of the ring head and the female opening could be provided in the insert 14, rather than vice-versa as illustrated.

It is seen therefore that the instant invention provides an effective combination of a finger ring and size adjustment insert. The insert can easily be twisted into and out of the opening in the back side of the decorative head of the ring and is provided in different size thicknesses to adjust the finger-receiving opening of the ring to the appropriate size. Further, the insert is formed from a resilient plastic material which is comfortable to wear against the skin, and which does not have any exposed edges which can snag clothing. Once mounted, the insert stays firmly in place, even if relative movement between the wearer's finger and the ring should take place. Also, the inserts, being of molded plastic, are easy and inexpensive to manufacture, but yet are durable and long lasting in use.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In combination, a finger ring comprising a decorative head and a ring shank which cooperate to define a finger-receiving opening of a predetermined size, said decorative head including an outwardly facing decorative side and an inwardly facing back side, and a resilient insert for reducing the size of said finger-receiving opening comprising a substantially arcuate body portion having a generally convex upper surface, a generally concave lower surface, and a male protrusion projecting outwardly from said upper surface, said male protrusion comprising a pedestal portion projecting upwardly from said upper surface, and pair of wing portions extending outwardly therefrom, said back side of said finger ring having a complementary female opening formed therein for receiving said male protrusion, said female opening including a pair of recessed portions at the sides thereof for receiving said wing portions, said insert being rotatable relative to said ring wherein said wing portions rotate relative to said recessed portions and frictionally engage with said female opening, said pedestal portion being circular in configuration, said wing portions extending outwardly therefrom in diametrically opposing directions.

2. In combination, a finger ring comprising a decorative head and a ring shank which cooperate to define a finger-receiving opening of a predetermined size, said decorative head including an outwardly facing decorative side and an inwardly facing back side, and a resilient insert for reducing the size of said finger-receiving opening comprising a substantially arcuate body portion having a generally convex upper surface, a generally concave lower surface, and a male protrusion projecting outwardly from said upper surface, said male protrusion comprising a substantially circular pedestal portion projecting upwardly from said upper surface, and pair of wing portions extending outwardly therefrom in diametrically opposing directions, said back side of said finger ring having a complementary female opening formed therein for receiving said male protrusion, said female opening including a pair of recessed portions at the sides thereof for receiving said wing portions, said insert being rotatable relative to said ring wherein said wing portions rotate relative to said recessed portions and frictionally engage with said female opening, said pedestal portion including diametrically opposed bumps thereon in linear alignment with said wing portions, said female opening including complementary indentations in the side wall thereof for receiving said bumps and maintaining said insert in assembled relation when said insert has been rotated into locking position.

3. In the combination of claim 2, said male protrusion having a centrally located V-shaped channel to enhance the flexibility thereof.

4. In combination, a finger ring comprising a decorative head and a ring shank which cooperate to define a finger-receiving opening of a predetermined size, said decorative head including an outwardly facing decorative side and an inwardly facing back side, and a resilient insert for reducing the size of said finger-receiving opening comprising a substantially arcuate body portion having a generally convex upper surface, a generally concave lower surface, and a male protrusion projecting outwardly from said upper surface, said male protrusion comprising a pedestal portion projecting upwardly from said upper surface, and pair of wing portions extending outwardly therefrom, said back side of said finger ring having a complementary female opening formed therein for receiving said male protrusion, said female opening including a pair of recessed portions at the sides thereof for receiving said wing portions, said insert being rotatable relative to said ring wherein said wing portions rotate relative to said recessed portions and frictionally engage with said female opening, said male protrusion including a conical depression centrally located at an upper edge thereof for receiving the pointed rear end of an ornamental stone.

* * * * *